US006612457B1

(12) United States Patent
Caron

(10) Patent No.: US 6,612,457 B1
(45) Date of Patent: Sep. 2, 2003

(54) REFUSE CONTAINER

(76) Inventor: Pierre-Nelson Caron, 17, Maurice, St-Constant, Québec (CA), J5A 1T8

( * ) Notice: Subject to any disclaimer, the term of this patent is extended or adjusted under 35 U.S.C. 154(b) by 168 days.

(21) Appl. No.: 09/696,249

(22) Filed: Oct. 26, 2000

(30) Foreign Application Priority Data

Oct. 29, 1999 (GB) ..... 9925534

(51) Int. Cl.[7] ..... B65D 25/24; B65D 21/02; B65D 25/22

(52) U.S. Cl. ..... 220/480; 220/980; 220/908.1; 220/23.89; 220/475; 220/482; 220/4.28; 428/907; 428/105; 428/225.21

(58) Field of Search ..... 248/97, 146, 150, 248/214, 215, 225.11, 225.21, 907; 220/908, 23.87, 908.1, 23.89, 475, 482, 4.28; 206/366, 370

(56) References Cited

U.S. PATENT DOCUMENTS

| | | | | | |
|---|---|---|---|---|---|
| 1,511,982 | A | * | 10/1924 | Schilling | 220/908 X |
| 3,255,986 | A | * | 6/1966 | Eadie | 248/907 X |
| 3,298,655 | A | * | 1/1967 | Palm | 248/498 |
| 4,069,997 | A | * | 1/1978 | Weiss | 248/203 |
| 4,576,281 | A | * | 3/1986 | Kirksey | 206/366 X |
| 4,662,516 | A | * | 5/1987 | Baker, Sr. et al. | 206/366 X |
| 4,809,850 | A | * | 3/1989 | Leible et al. | 206/366 |
| 4,869,366 | A | * | 9/1989 | Bruno | 206/366 X |
| 4,911,294 | A | * | 3/1990 | Russo et al. | 206/366 |
| 4,911,325 | A | * | 3/1990 | De Guilio | 220/404 |
| 4,930,631 | A | * | 6/1990 | Bruno | 206/366 |
| 4,955,497 | A | * | 9/1990 | Winden et al. | 220/408 |
| 5,027,948 | A | * | 7/1991 | Forbes et al. | 220/482 X |
| 5,076,429 | A | * | 12/1991 | Patrick et al. | 206/366 X |
| 5,213,294 | A | * | 5/1993 | DeBord | 248/147 |
| 6,076,694 | A | * | 6/2000 | Ragot | 220/23.83 |
| 6,241,115 | B1 | * | 6/2001 | Delmerico et al. | 220/495.06 |

* cited by examiner

*Primary Examiner*—Tri M. Mai

(57) ABSTRACT

A refuse container for receiving refuse being mountable to a stable surface such as wall or a ground surface comprising:

an anchoring structure;

an anchoring structure-to-stable surface attachment for solidly attaching the anchoring structure to said stable surface;

a protective casing defining an enclosed casing volume, and defining a casing aperture for allowing the refuse to be inserted into the casing volume;

a casing-to-anchoring structure releasable attachment for releasably attaching the protective casing to the anchoring structure;

an open top refuse receptacle mounted within the casing volume and positioned so as to receive the refuse when dropped into the casing volume from the casing aperture;

a theft prevention means for selectively preventing the detachment of the protective casing from the anchoring structure and selectively preventing the withdrawal of the refuse receptacle from the casing volume.

15 Claims, 4 Drawing Sheets

44
78
24
20
76
32
96
22
70
98
146
282
30
34
26
126
124
40
68
28
86
90
72
88
92
94
60
136
48
40
112
110
116
58
38
84
114
64
62
54
66
60
46
42
20
36
52
48
34
40
56
38
48
54
50
64
56
58
62
86
60
64
50
46
62
136

96
104
108
100
76
102
106
52
40
118
132
130
128
126
124
68
28
122
120
136
58
54
86
90
88
92
94
60
146
16
142
144
140
82

REFUSE CONTAINER

FIELD OF THE INVENTION

The present invention relates to the field of specialized receptacles and is particular concerned with a receptacle unit for both refuse and ash.

BACKGROUND OF THE INVENTION

Recent government regulations in some areas have made it illegal to smoke indoors in public areas. Accordingly, a large number of tobacco smokers must now resort to smoking outdoors. In order to maintain an appearance of neatness and cleanliness, most public areas therefore are encouraged to provide some means preferably in the form of ashtrays for receiving ash and cigarette butts.

In restaurants, theaters and other establishments where people gather, the convenient disposition of various papers and plastic items such as drinking straws, waxed paper for butter pats, candy and gum wrappers, empty cigarette packages or the like, is a problem. In areas wherein smokers are encouraged to smoke outdoors, refuse or trash containers are generally provided adjacent outdoor ashtrays. Refuse containers are added despite the presence of ashtrays since trash items should not be placed in receptacles containing cigarette ashes because of their relative flammability. Any trash being carelessly dropped into an ashtray containing an unextinguished cigarette may potentially create a small but potentially dangerous blaze. Furthermore, ashtrays are generally too shallow to hold trash paper. Thus the trash are susceptible to being scattered about thereby creating a disorderly appearance. Additionally, areas littered by small papers, plastic material or the like require increased time by personnel to clean.

The prior art has shown some examples of combination trash and ash receptacles. For example, it is known in the prior art you have ashtrays with collapsible bottoms functioning to empty ashes from the ashtray into a larger container below.

These receptacles are designed to receive large quantity of ashes before emptying is necessary and are not designed to be trash receptacles. Any trash deposited in them is mixed with the ashes and is subject to catching fire. Also, previously, ashtrays have been combined with containers such as for tobacco, cigarettes and matches. Most of these devices serve as smokers' appliances by providing a container for the tobacco or cigarettes and a combined closure-ashtray.

The closure-ashtrays are generally designed to function as covers for the containers until the tobacco or cigarettes are depleted and the containers discarded. Further, the closure-ashtray must be removed to gain access into the container.

Another drawback commonly associated with prior art combination trash/ash receptacles is that they are typically cumbersome and are not ergonomically optimized.

Since public areas are often crowded for space most prior art structures take up room in an objectable manner. Still further, most prior art structures suffer from lacing in theft prevention features. Indeed, it is a sad reality of modem times that objects left outdoors and unattended are subject to being vandalized and stolen. Thus, it relatively often happens with prior art structures that the latter be stolen requiring costly replacement.

Also, some of the prior art structures suffer from defining horizontal surfaces which could be unwantingly used by lazy individuals as permanent resting surfaces for their trash and other materials. Still further, some prior art structures were unergonomically designed and, thus, do not allow for quick and easy maintenance and cleaning thereof.

Furthermore, some of the prior art structures are relatively complex and require different manufacturing processes for the ashtray and trash receptacle sections. The different design used for the ashtray and the trash receptacle not only increases the production cost but also suffers from providing an aesthetical solutions. Accordingly, there exists a need for an improved combination refuse and ash receptacle unit.

Advantages of the present invention include the fact that in one embodiment of the invention the proposed refuse and ash receptacle unit provides separate containers for trash and ash thus reducing the risk of dangerous blazes resulting from trash being carelessly dropped in an ashtray containing an unextinguished cigarette. Further, the proposed unit is specifically configured so as to deter individuals from inadvertently throwing trash into the ashtray container.

Also, the proposed refuse and ash receptacle unit is provided with a space saving design so as to take up room in an objectionable manner. Furthermore, the proposed refuse and ash receptacle unit is provided with top surface adapted to deter individuals from inadvertently leaving objects thereon. Still further, the proposed unit is provided with integral locking means for reducing the risk of theft thereof. Still further, the proposed unit has built-in ergonomic features for facilitating maintenance and cleaning thereof. Also, the proposed unit is specifically designed so as to be mountable either to a vertical or an horizontal supporting structure.

Furthermore, the present invention provides for a structure that can be adapted with limited modifications to be used either as a trash receptacle for receiving conventional trash or as an ashtray. Thus, the same structure with small modifications can serve either purpose and, hence, relative similar structures can be mounted adjacent one another and destined for separate uses.

SUMMARY OF THE INVENTION

In accordance with an embodiment of the invention there is provided a refuse container for receiving refuse, the refuse container being mountable to a stable surface such as a wall or a ground surface, the refuse container comprising an anchoring structure; an anchoring structure-to-stable surface attachment means for solidly attaching the anchoring structure to the stable surface; a protective casing defining an enclosed casing volume, the protective casing also defining a casing aperture for allowing the refuse to be inserted into the casing volume; a casing-to-anchoring structure releasable attachment means for releasably attaching the protective casing to the anchoring structure; an open top refuse receptacle mounted within the casing volume and positioned so as to receive the refuse when dropped into the casing volume from the casing aperture; a theft prevention means for selectively preventing the detachment of the protective casing from the anchoring structure and selectively preventing the withdrawal of the refuse receptacle from the casing volume.

Preferably, the protective casing includes a first casing segment and a second casing segment, the first casing segment and the second casing segment being detachably attached together by a segment attachment means; the theft prevention means includes a releasable locking means for releasably locking together the first casing segment and the second casing segment in a segment locked configuration.

Conveniently, the casing aperture extends through the first casing segment and the casing-to-anchoring structure releasable attachment means cooperates with the second casing segment for releasably attaching the protective casing to the anchoring structure.

Preferably, the anchoring structure defines a generally horizontally extending hooking edge and a generally vertical fastening surface; the second casing segment includes a rear wall; a hooking structure extends rearwardly from the rear wall, the hooking structure being configured, sized and positioned so as to be releasably hookable over the hooking edge part of the anchoring structure; a casing-to-anchoring structure fastening means extends through both the rear wall and the fastening surface for fastening the casing to the anchoring structure when the hooking structure is hooked on the hooking edge, the fastening means being configured so as to be accessible only when the first casing segment is at least partially separated from the second casing segment.

Conveniently, the rear wall has a generally rectangular configuration defining a rear wall upper peripheral edge, a rear wall lower peripheral edge and a pair of opposed rear wall side peripheral edges, the hooking structure extending rearwardly from the rear wall substantially adjacent the rear wall upper peripheral edge;

the casing-to-anchoring structure fastening means including at least one rear wall aperture extending through the rear wall substantially adjacent the rear wall lower peripheral edge; the hooking structure defines a generally horizontally extending first anchoring strip, the first anchoring strip defining the hooking edge; the hooking structure also defines a generally horizontally extending second anchoring strip;

the casing-to-anchoring structure fastening means also includes at least one anchoring strip aperture extending through the second anchoring strip so as to be substantially in register with the at least one rear wall aperture when the hooking structure is hooked on the hooking edge; the casing-to-anchoring structure fastening means further includes a fastening component extending through both the at least one rear wall aperture and the at least one anchoring strip aperture when the casing is fastened to the anchoring structure.

Preferably, the first casing segment and the second casing segment when assembled together cooperate to form a segment guiding means, the segment guiding means allowing the first casing segment and the second casing segment to move relative to each other in a predetermined axial direction while preventing other relative displacements therebetween; the releasable locking means releasably and selectively preventing relative displacement between the first casing segment and the second casing segment along the predetermined axial direction.

Conveniently, the second casing segment defines a bottom wall, the bottom wall extending from the rear wall lower peripheral edge, the bottom wall defining a bottom wall rear peripheral edge merging with the rear wall lower peripheral edge, a bottom wall front peripheral edge and a pair of opposed bottom wall side peripheral edges; the first casing segment defines a front wall, the front wall defining a front wall upper peripheral edge, a front wall lower peripheral edge and a pair of opposed front wall side peripheral edges; the first casing segment also defines a top wall, the top wall extending from the front wall upper peripheral edge, the top wall defining a top wall front peripheral edge merging with the front wall upper peripheral edge, a top wall rear peripheral edge and a pair of opposed top wall side peripheral edges; the first casing segment further defines a pair of side walls, each of the side walls defining a corresponding side wall upper peripheral edge merging with an adjacent top wall side peripheral edge, each of the side walls also defining a corresponding side wall lower peripheral edge merging with an adjacent bottom wall side peripheral edge, each of the side walls further defining a corresponding side wall front peripheral edge merging with an adjacent front wall side peripheral edge; the releasable locking means including a locking lip extending inwardly from the front wall lower peripheral edge and a locking mechanism mounted on the bottom wall adjacent the bottom wall front peripheral edge, the locking mechanism being provided with a locking tongue, the locking tongue being pivotally mounted on the bottom wall so as to selectively pivot between the segment locked configuration whereby the locking tongue abuttingly contacts the locking lip and a segment unlocked configuration whereby the locking tongue clears the locking lip.

In one embodiment of the invention, the top wall is provided with a top wall lip extending substantially downwardly and at an angle from the top wall rear peripheral edge, the top wall and the top wall lip together defining a top wall hooking section, the top wall hooking section being hookingly mounted over the rear wall upper peripheral edge when the first casing segment and the second casing segment are assembled together.

Conveniently, the refuse container further comprises a top wall guiding tongue extending from the inner surface of the top wall, the top wall guiding tongue having a tongue guiding section that extends in a generally parallel and inwardly spaced relationship relative to the top wall lip so as to define a top wall guiding channel therebetween, the top wall guiding channel being configured and sized for substantially fittingly and slidably receiving the rear wall upper peripheral edge.

In another embodiment of the invention, the rear wall is provided with a rear wall recessed section positioned adjacent the rear wall upper peripheral edge, the top wall recessed section defining a rear wall spacing segment and a rear wall abutting segment, the rear wall spacing segment extending substantially inwardly and at an angle relative to an adjacent section of the rear wall, the rear wall abutting segment extending substantially upwardly from the rear wall spacing segment in a generally parallel and inwardly recessed relationship relative to the adjacent section of the rear wall, whereby when the first and second casing segments are assembled, a distal tip of the top wall lip abuttingly contacts the exterior surface of the rear wall spacing segment and the inner surface of the top wall lip abuttingly contacts the exterior surface of the rear wall abutting segment.

Conveniently, each of the side walls is provided with a side wall rear lip and a side wall bottom lip, each of the side wall rear lips extending substantially inwardly and perpendicularly relative to the side wall rear peripheral edge; each of the side wall bottom lips extending substantially inwardly and perpendicularly relative to the side wall bottom peripheral edge; whereby the side wall rear lips and the side wall bottom lips abuttingly contact respectively the rear wall and the bottom wall when the first and second casing segments are assembled together.

Preferably, a lip spacing is provided between adjacent side wall rear lips and side wall bottom lips, the lip spacing being configured and sized so as to allow slidable movement thereinto of the rear wall; whereby when the first and second casing segments are assembled together the inner surface of the side wall rear lips abuttingly contacts the outer surface of the rear wall, the outer surface of the side wall bottom lips abuttingly contact the inner surface of the bottom wall and a segment of the rear wall adjacent each rear wall peripheral edge is inserted between the side wall rear lips and the side wall bottom lips.

Conveniently, a lip abutment rail extends substantially inwardly from both the rear wall and the bottom wall respectively adjacent the rear wall side peripheral edges and the bottom wall side peripheral edges; whereby when the first and second casing segments are assembled together the inner surface of the side wall rear lips abuttingly contacts the inner surface of the rear wall, the outer surface of the side wall bottom lips abuttingly contact the inner surface of the bottom wall and the inner peripheral edge of the side wall rear lips and the side wall bottom lips abuttingly contact the lip abutment rails.

Conveniently, the refuse container further comprises a guiding rod extending from the inner surface of the bottom wall, the guiding rod also extending trough a guiding rod aperture formed in one of the side wall bottom lips; whereby the guiding rod guides the relative movement between the first and second casing segments when the latter are separated from each other. Preferably, the guiding rod defines a guiding rod distal end, the guiding rod distal end being provided with a course limiting means for limiting the relative movement between the first and second casing segments when the latter are separated from each other.

Conveniently, the refuse container further comprises a refuse container releasable mounting means extending from the inner surface of the front wall for releasably mounting the refuse container to the front wall in a spaced relationship relative to the bottom wall. Preferably, the top wall extends generally frontwardly and downwardly in a direction leading from the rear wall upper peripheral edge to the front wall upper peripheral edge.

Conveniently, the refuse container further comprises a lid pivotally mounted to the front wall so as to pivot between a lid closed position wherein the lid extends across the refuse aperture and a lid open position wherein the lid allows the refuse to be inserted through the refuse aperture, the lid being provided with a lid biasing means for biasing the lid towards the lid closed position.

In one embodiment of the invention, the anchoring structure includes an anchoring base and a pair of anchoring posts extending upwardly from the anchoring base, the anchoring strips extending between the anchoring posts; whereby the anchoring base is anchorable to the ground surface using the anchoring structure-to-stable surface attachment means.

In another embodiment of the invention, the anchoring structure includes an anchoring plate and a pair of plate spacing legs extending substantially outwardly from the anchoring plate, the anchoring strips extending from the plate spacing legs; whereby the anchoring plate is anchorable to the wall surface using the anchoring structure-to-stable surface attachment means.

BRIEF DESCRIPTION OF THE DRAWINGS

An embodiment of the present invention will now be disclosed, by way of example, in reference to the following drawings in which.

DETAILED DESCRIPTION

Figure 1:
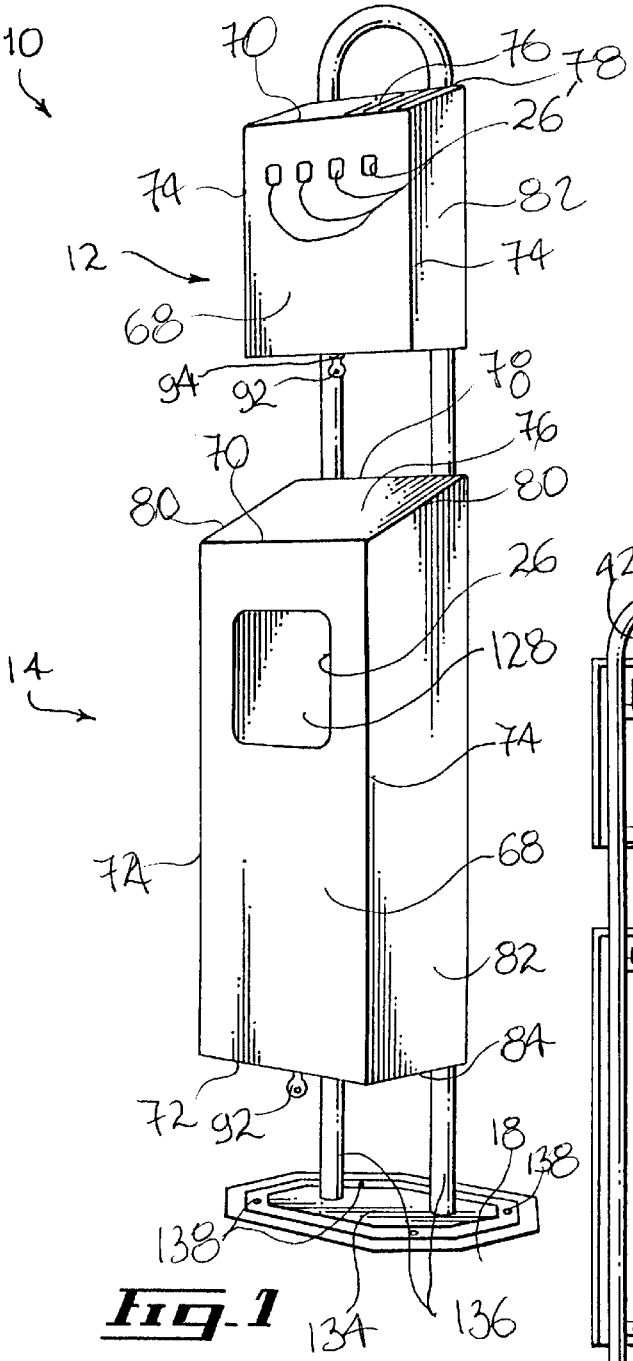
FIG. 1: in a perspective view, illustrates a combination ashtray and garbage container in accordance with an embodiment of the present invention.

Referring to FIG. 1, there is shown a combination ashtray and garbage container 10 in accordance with an embodiment of the present invention.

The combination ashtray and garbage container 10 typically includes an ashtray section 12 adapted to be used for receiving cigarette butts, cigarette ash and similar material.

The ashtray and garbage container 10 also includes a garbage container section 14 adapted to receive conventional refuse or trash such as soiled paper, empty cigarette packs or the like.

Figure 2:
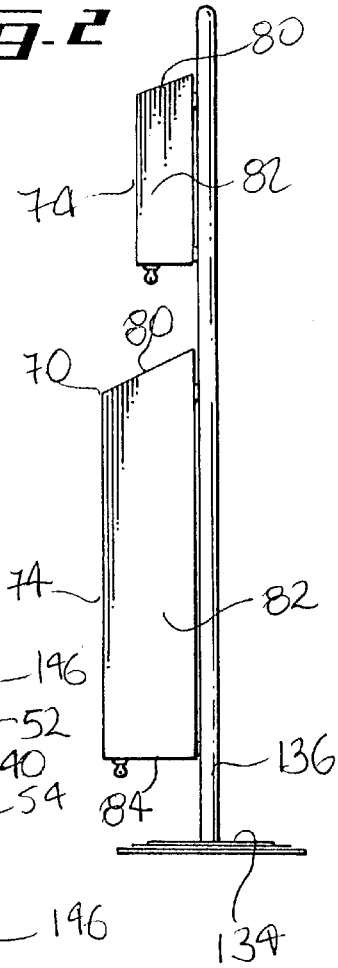
FIG. 2: in a side elevation view, illustrates the combination ashtray and garbage container shown in FIG. 1.
Figure 3:
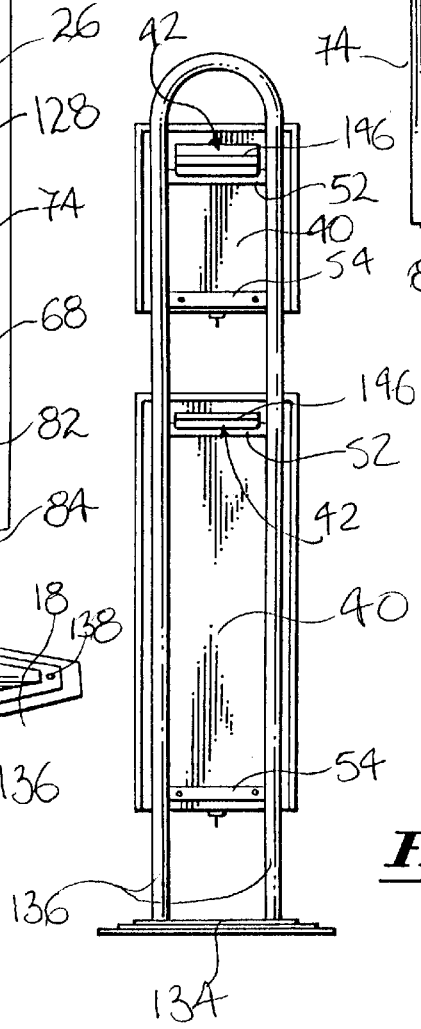
FIG. 3: in a rear elevational view, illustrates the combination ashtray and garbage container shown in FIGS. 1 and 2.
Figure 4:
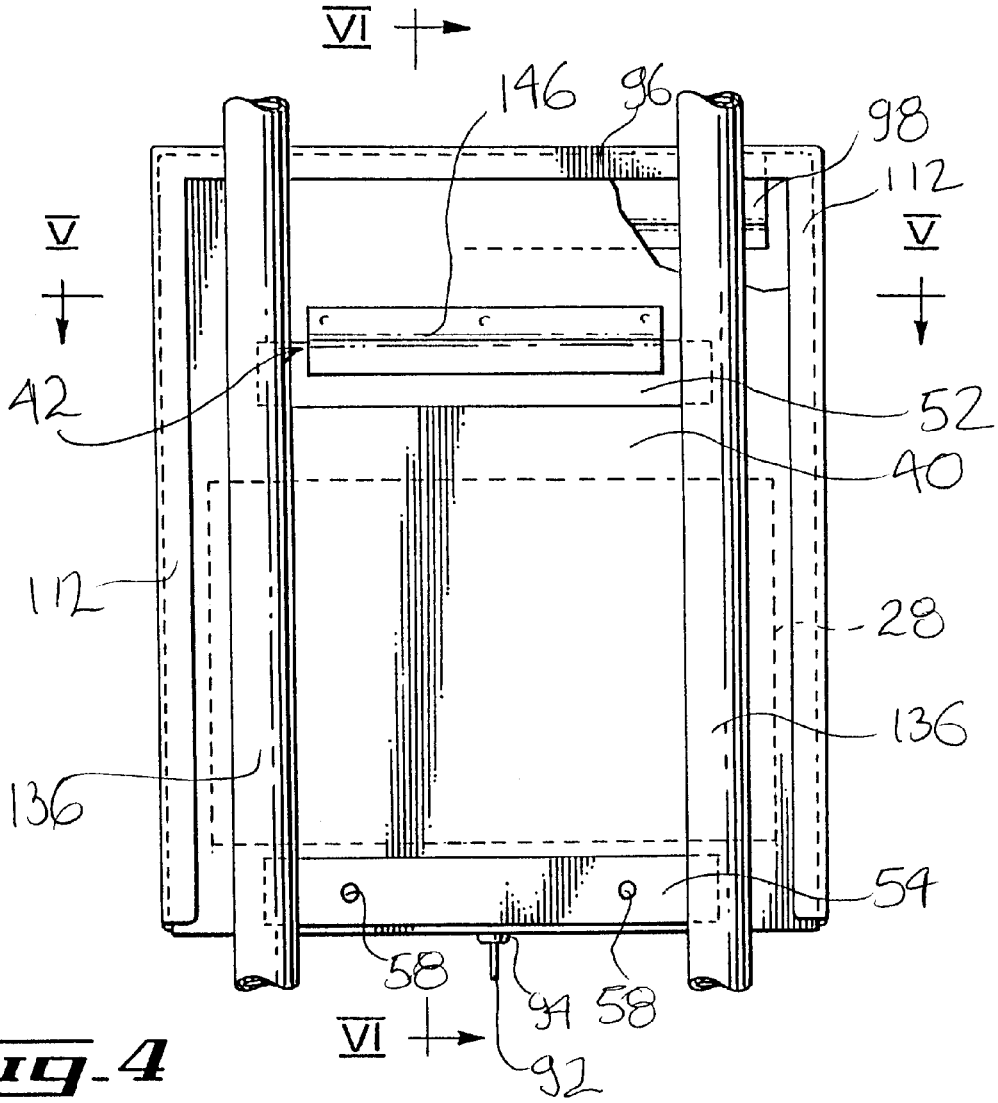
FIG. 4: in a detail rear view with sections taken out, illustrates part of the ashtray section of the combination ashtray and garbage container shown in FIGS. 1 through 3.
Figure 5:
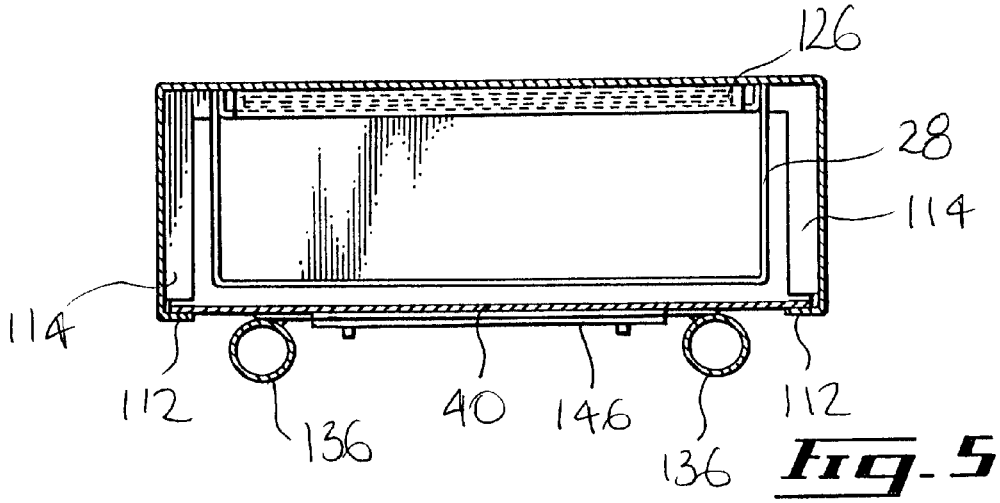
FIG. 5: in a transversal cross sectional view taken along arrows V V of FIG. 4, illustrates some of the internal components of the ashtray section part of the combination ashtray and garbage container shown in FIGS. 1 through 4.

It should be understood that although FIGS. 1 through 3 illustrate the ashtray section 12 mounted above the garbage container section 14, other relative positioning between the ashtray component 12 and the garbage container 14 could be used without departing from the scope of the present invention. Also, it should be understood that both the ashtray section 12 and the garbage container section 14 could be used separately without departing from the scope of the present invention. Furthermore it should be understood that the ashtray section 12 and the garbage container section 14 have similar constructions and, hence, could be used interchangeably without departing from the scope of the present invention.

In the following text, both the ashtray container section 12 and the garbage container section 14 are initially referred to as a refuse container and are initially disclosed as being individually mounted to a stable surface such as a wall surface 16 or a ground surface 18.

Each refuse container 12, 14 includes an anchoring structure 20 and an anchoring structure-to-stable surface attachment means for solidly attaching the anchoring structure 20 to a stable surface such as the wall 16 or the ground surface 18. Each refuse container 12, 14 also includes a protective casing 22 defining an enclosed inner casing volume 24. The protective casing 22 also defines a casing aperture 26 for allowing refuse to be inserted into the casing volume 24. When the refuse container takes the form of an ashtray section 12 the casing aperture 26 preferably takes the form of a set of cigarette butt apertures 26', configured and sized for receiving cigarette butts and the lighted end of cigarettes in order to receive the burning ash therefrom.

The refuse container also includes a casing-to-anchoring structure releasable attachment means for releasably attaching the protective casing 22 to the anchoring structure 20. An open top refuse receptacle 28 is mounted within the casing volume 24 and positioned so as to receive the refuse when dropped into the casing volume 24 from the casing aperture 26 as indicated by arrow XXX in FIG. 6.

The refuse container further includes a theft prevention means for selectively preventing the detachment of the protective casing 22 from the anchoring structure 20 and also for selectively preventing the withdrawal of the refuse receptacle 28 from the casing volume 24.

Figures 6, 7, 8:
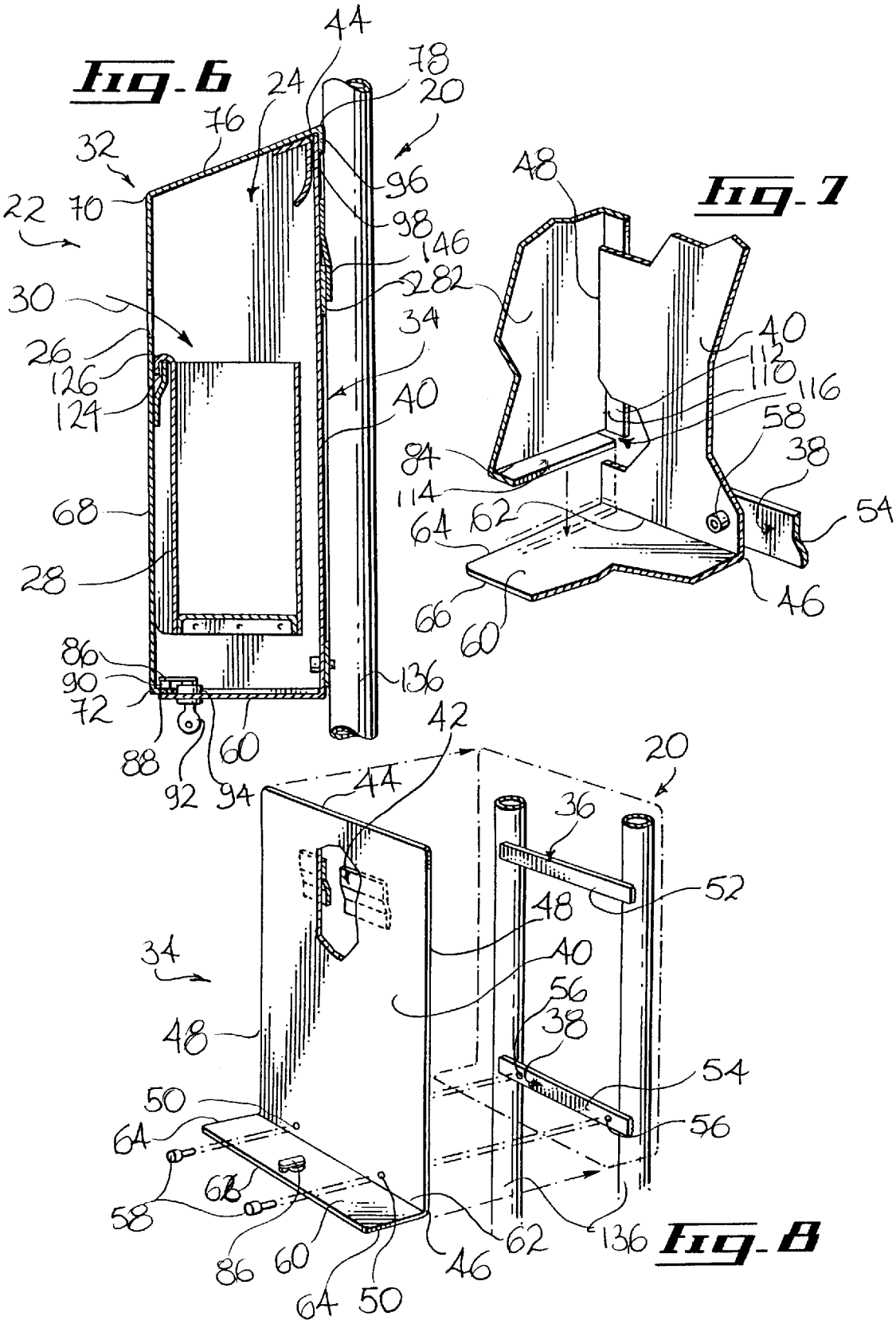
FIG. 6: in a longitudinal cross sectional view taken along arrows VI VI in FIG. 4, illustrates some of the internal components of the ashtray section part of the combination ashtray and garbage container shown in FIGS. 1 through 5.
FIG. 7: in a partial detail perspective view with sections taken out, illustrates part of the ashtray casing as it is being assembled.
FIG. 8: in a partial perspective view with sections taken out, illustrates part of the ashtray casing being mounted to an anchoring structure. The ashtray casing and anchoring structure being part of the combination ashtray and garbage container shown in FIGS. 1 through 7.

The protective casing 22 typically include a first casing segment 32 and a second casing segment 34 isolated from the first casing segment 32 in FIG. 8. The first casing segment 32 and the second casing segment 34 are detachably attached together by a segment attachment means. The theft prevention means includes a releasable locking means for releasably locking together the first casing segment 32 and the second casing segment 34 in a segment locked configuration. Preferably, the casing aperture 26 extends through the first casing segment 32 and the casing to anchoring structure releasable attachment means cooperates with the second casing segment 34 for releasably attaching the protective casing 22 to the anchoring structure 20.

As shown more specifically in FIG. 8, the anchoring structure 20 defines a generally horizontally extending hooking edge 36 and a generally vertical fastening surface 38. The second casing segment 34 includes a rear wall 40.

A hooking structure 42 extends rearwardly from the rear wall 40. The hooking structure 42 is configured, sized and positioned so as to be releasably hookable over the hooking edge 36, part of the anchoring structure 20.

A casing-to-anchoring structure fastening means extends through both the rear wall 40 and the fastening surface 38 for fastening the protective casing 22 to the anchoring structure 20 when the hooking structure 42 is hooked on the hooking edge 36. The casing-to-anchoring structure fastening means is configured so as to be accessible, that is fastenable and unfastenable only when the first casing segment 32 is at least partially separated from the second casing segment 34.

The rear wall 40 has a generally rectangular configuration defining a rear wall upper peripheral edge 44, a rear wall lower peripheral edge 46 and a pair of opposed rear wall side peripheral edges 48. The hooking structure 42 preferably extends rearwardly from the rear wall 40 substantially adjacent the rear wall upper peripheral edge 44.

The casing-to-anchoring structure fastening means typically includes at least one and preferably two rear wall apertures 50, extending through the rear wall 40, substantially adjacent the rear wall lower peripheral edge 46.

The anchoring structure 20 defines a generally horizontally extending first anchoring strip 52. The first anchoring strip 52 defining the hooking edge 36. The anchoring structure 20 also defines a generally horizontally extending second anchoring strip 54. The second anchoring strip 54 defining the fastening surface 38.

The casing-to-anchoring structure fastening means also includes at least one and preferably two anchoring strip apertures 56, extending through the second anchoring strip 54. The anchoring strip apertures 56 are positioned so as to be substantially in register with the corresponding rear wall apertures 50 when the hooking structure 42 is hooked on the hooking edge 36. The casing-to-anchoring structure fastening means further includes at least one and preferably two fastening components 58, such as bolts, rivets or the like extending through both the rear wall apertures 50 and the anchoring strip apertures 56 when the protective casing 22 is fastened to the anchoring structure 20.

The first casing segment 32 and the second casing segment 34 when assembled together cooperate to form a segment guiding means. The segment guiding means allows the first casing segment 32 and the second casing segment 34 to move relative to each other in a predetermined axial direction while preventing other relative displacements therebetween. The releasable locking means releasably and selectively prevents the relative displacement between the first casing segment 32 and the second casing segment 34 along the predetermined axial direction.

The second casing segment 34 defines a bottom wall 60. The bottom wall 60 extends from the rear wall lower peripheral edge 46. The bottom wall 60 defines a bottom wall rear peripheral edge 62 merging with the rear wall lower peripheral edge 46. The bottom wall 60 also defines a bottom wall front peripheral edge 66 and a pair of opposed bottom wall side peripheral edges 64.

The first casing segment 32 defines a front wall 68. The front wall 68, in turn, defines a front wall upper peripheral edge 70, a front wall lower peripheral edge 72 and a pair of opposed front wall side peripheral edges 74.

The first casing segment 32 also defines a top wall 76. The top wall 76 extends from the front wall upper peripheral edge 70. The top wall 76 define a top wall front peripheral edge merging with the front wall upper peripheral edge 70. The top wall 76 also defines a top wall rear peripheral edge 78 and a pair of opposed top wall side peripheral edges 80. The top wall 76 preferably extends generally frontwardly and downwardly in a direction leading from the rear wall upper peripheral edge 44 to the front wall upper peripheral edge 70.

The first casing segment 32 further defines a pair of side walls 82. Each side wall 82 defines a corresponding side wall upper peripheral edge merging with an adjacent top wall side peripheral edge 80. Each side wall 82 also defines a corresponding side wall lower peripheral edge 84. Each side wall 82 further defines a corresponding side wall front peripheral edge merging with an adjacent front wall side peripheral edge 74. Each side wall 82 still further defining a corresponding side wall rear peripheral edge 110.

The releasable locking means typically includes a locking lip 88 extending inwardly from the front wall lower peripheral edge 72. The locking mechanism is provided with a locking tongue 86. The locking tongue 86 is pivotally mounted on the bottom wall 60 so as to selectively pivot between the segment locked configuration whereby the locking tongue 86 abuttingly contacts the locking lip 88 and a segment unlocked configuration whereby the locking tongue 86 clears the locking lip 88. Preferably, a locking spacer 90 is solidly attached to the locking tongue 86 for filling the gap between the locking tongue 86 and the locking lip 88. The locking tongue 86 is adapted to be selectively pivoted between the segment locked and unlocked configurations using a suitable test prevention identification means such as a key-lock-mechanism 94 and associated key 92.

The top wall 76 is preferably provided with a top wall lip 96 extending substantially downwardly and at an angle from the top wall rear peripheral edge 78. The top wall 76 and the top wall lip 96, together define a top wall hooking section. The top wall hooking section is hookingly mounted over the rear wall upper peripheral edge 44 when the first casing segment 32 and the second casing segment 34 are assembled together, as shown in FIGS. 6 and 9.

The refuse container 10 is optionally further provided with a top wall guiding tongue 98 extending from the inner surface of the top wall 76. The top wall guiding tongue 98 has a tongue guiding section that extends in a generally parallel and inwardly spaced relationship relative to the top wall lip 96 so as to define a top wall guiding channel therebetween. The top wall guiding channel is configured and sized for substantially fittingly and slidably receiving the rear wall upper peripheral edge 44, as shown in FIG 6.

Figures 9, 10, 11, 12:
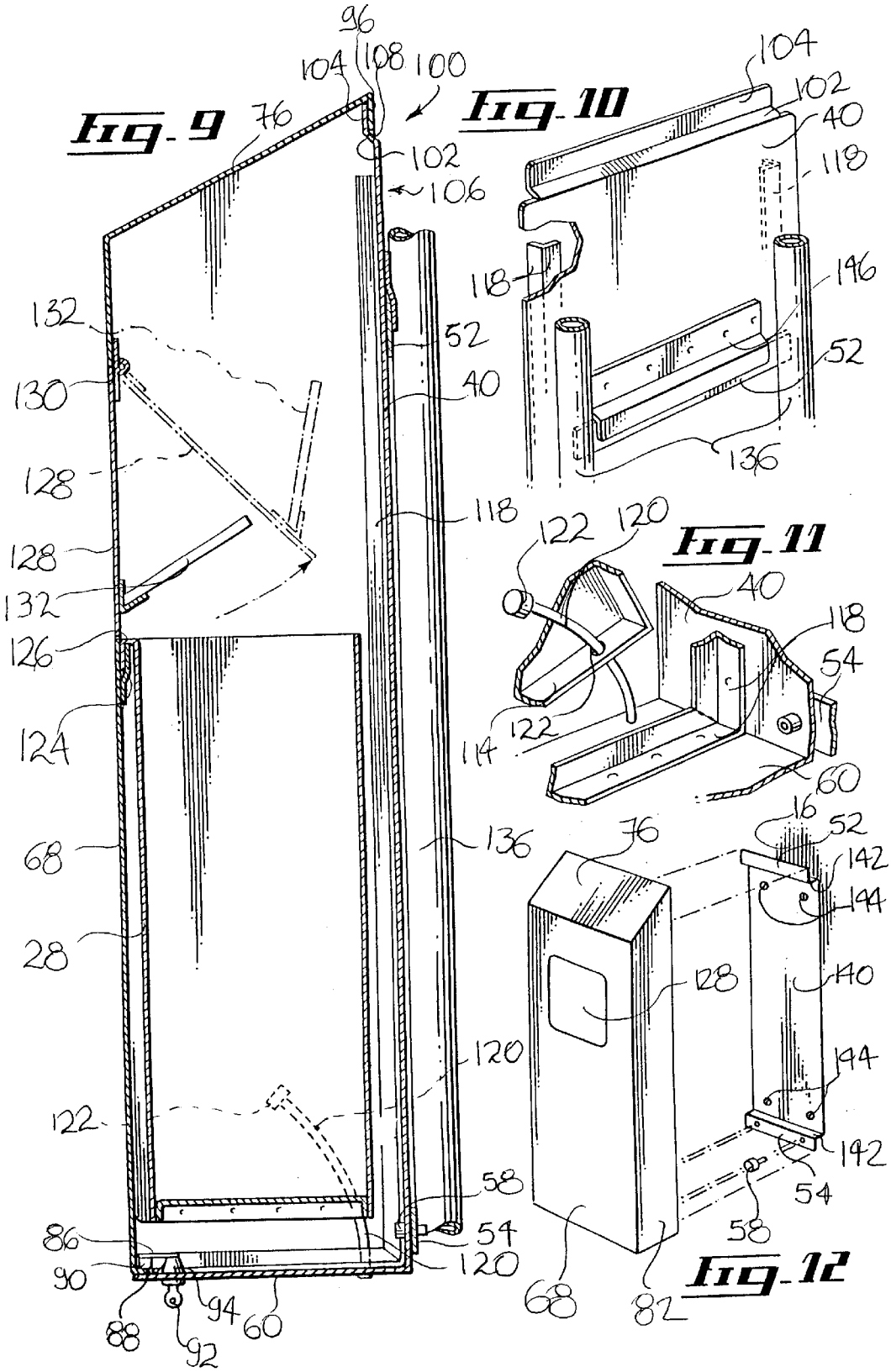
FIG. 9: in longitudinal cross sectional view, illustrates some of the internal components of the garbage container part of the combination ashtray and garbage container shown in FIGS. 1 through 8.
FIG. 10: in partial rear perspective view with sections taken out, illustrates part of the garbage container section of the combination ashtray and garbage container shown in FIGS. 1 through 9.
FIG. 11: in a detail perspective view, illustrates a guiding pin mounted to corresponding guided sections part of the garbage container of the ashtray and garbage container combination shown in FIGS. 1 through 10.
FIG. 12: in a perspective view, illustrates a garbage container about to be mounted to an anchoring structure in accordance with a second embodiment of the present invention.

In one embodiment of the invention particularly well suited in situations wherein the refuse container is used for receiving garbage such as the refuse container 14, shown in FIG. 1, the rear wall 40 is provided with a rear wall recessed section 100, as shown more clearly in FIG. 9. The rear wall recessed section 100 is positioned adjacent the rear wall upper peripheral edge 78. The rear wall recessed section 100 defines a rear wall spacing segment 102 and a rear wall abutting segment 104. The rear wall spacing segment 102 extends substantially inwardly and at an angle relative to an adjacent section 106 of the rear wall 40.

The rear wall abutting segment 104 extend substantially upwardly from the rear wall spacing segment 102 in a generally parallel and inwardly recessed relationship relative to the adjacent section 106 of the rear wall 40. The first and second casing segments 32, 34 are assembled together, a distal tip 108 of the top wall lip 96 contacts the exterior surface of the rear wall spacing segment 102 and the inner surface of the top wall lip 96 abuttingly contacts the exterior surface of the rear wall abutting segment 104.

Each side wall 82 is preferably provided with a side wall rear lip 112 and a side wall bottom lip 114, as shown more specifically in FIG. 7. Each side wall rear lip 112 extend substantially inwardly and perpendicularly relative to an adjacent side wall rear peripheral edge 110. Each side wall bottom lip 114 extends substantially inwardly and perpendicularly relative to an adjacent side wall bottom peripheral edge 84. The side wall rear lips 112 and the side wall bottom lips 114 abuttingly contact respectively the rear wall 40 and the bottom wall 60 when the first and second casing segment 32, 34 are assembled together.

In one embodiment of the invention, more specifically adapted to be used as an ashtray section 12, a lip spacing 116 is provided between adjacent side wall rear lips 1 12 and side wall bottom lips 114. As shown more specifically in FIG. 7, the lip spacing 116 is configured and sized so as to allow slidable movement thereunto of the rear wall 40. When the first and second casing segment 32, 34 are assembled together, the inner surface of the side wall rear lip 112 abuttingly contacts the outer surface of the rear wall 40. When the first and second casing segment 32, 34 are assembled, the outer surface of the side wall bottom lip 114 abuttingly contacts the inner surface of the bottom wall 60 and a segment of the rear wall 40 adjacent the rear wall side peripheral edge 48 is inserted between an adjacent side wall rear lip 112 and side wall bottom lip 114.

In another embodiment of the invention, shown more specifically in FIGS. 9 through 11 and more specifically adapted to be used as a garbage container section 14, a lip abutment rail 118 extends substantially inwardly from both the rear wall 40 and the bottom wall 60 respectively adjacent the rear wall side peripheral edges 48 and the bottom wall side peripheral edges 64. When the first and second casing segments 32, 34 are assembled together, the inner surface of the side wall rear lip 112 abuttingly contacts the inner surface of the rear wall 40, the outer surface of the side wall bottom lip 114 abuttingly contacts the inner surface of the bottom wall 60 and the inner peripheral edge of the side wall rear lips 112 and side wall bottom lips 114 abuttingly contact the lip abutment rails 118.

In the embodiment shown in FIGS. 9 through 11, a guiding rod 120 extends from the inner surface of the bottom wall 60. The guiding rod 120 also extends through a guiding rod aperture 122 formed in one of the side wall bottom lips 114. Alternatively, a pair of guiding rods 120 may extend through corresponding opposite side wall bottom lips 114. Each guiding rod 120 defines a guiding rod distal end provided with a course limiting means preferably taking the form of an enlarged-section 122. The guiding rod 120 and the course limiting means 122 are adapted to guide the relative movement between the first and second casing segments 32, 34 when the latter are separated from each other. Hence, when the first casing segment 32, the side wall bottom lip 114 follow the trajectory of the guiding rod 120. The guiding rod 120 is preferably given a generally arcuate configuration such that the first casing segment 32 is spaced and angled relative to the second casing segment 34 once it reaches a course limiting means 122 thus facilitating access to the casing volume 34 for servicing the refuse receptacle 28.

A refuse receptacle releasable mounting means preferably extends from the inner surface of the front wall 68. The refuse receptacle releasable mounting means is adapted to releasably mount the refuse receptacle 28 to the front wall 68 in a spaced relationship relative to the bottom wall 60. The refuse receptacle releasable mounting means preferably takes the form of a front wall hooking clip 124, configured and sized for cooperating with a corresponding receptacle hooking clip 126 formed adjacent the upper peripheral edge of the refuse receptacle 28.

The refuse container 10 preferably further includes a lid 128, pivotally mounted by a lid hinge mechanism 130 to the inner surface of the front wall 68 so as to pivot between a lid opened position and a lid closed position. In the lid closed position, shown in full lines in FIG. 9, the lid extends across the refuse aperture 26. In the lid opened position, shown in phantom lines in FIG. 9, the lid 128 allows the refuse to be inserted through the refuse aperture 26. The lid 128 is preferably provided with a lid biasing means for biasing the lid 128 towards the lid closed position. In a preferred embodiment of the invention, the lid biasing means takes the form of a weighted plate 132, solidly anchored to the inner surface of the lid 128.

In a first embodiment of the invention shown in FIGS. 1 through 10, the anchoring structure includes an anchoring base 134 and a pair of anchoring posts 136 extending upwardly from the anchoring base 134. The anchoring base 134 is adapted to be anchored to the ground surface 18 using the anchoring structure-to-stable surface attachment means. Preferably, the anchoring structure-to-stable surface attachment means takes the form of bolts 138 or the like extending through corresponding bolt apertures formed in the anchoring plate 134. The first and second anchoring strips 52, 54 extending between the anchoring posts 136.

In another embodiment of the invention, shown in FIG. 12, the anchoring structure include an anchoring plate 140 and a pair of plate spacing legs 142 extending substantially outwardly from the longitudinal peripheral edges of the anchoring plate 140. The anchoring plate 140 is adapted to be anchored to a wall surface 16 using conventional fastening means such as screws 144 or the like extending through corresponding apertures formed in the anchoring plate 140. The first and second anchoring strips 52 54 extend integrally from the plate spacing legs 142. In both embodiments, the hooking structure preferably takes the form of a generally S-shaped hook 146 adapted to be hooked over the first anchoring strip 52.

A substantially similar construction can thus be used not only to form an ashtray receiving section 12 or a garbage receiving section 14 but also to provide a refuse container that can be easily adapted for secure attachment either to a ground surface 18 or a wall surface 16. Various types of anchoring structures can be developed defining first and second anchoring strips 52, 54 to provide an anchoring strategy similar to that hereinabove disclosed.

The embodiments of the invention in which an exclusive privilege or property is claimed are defined as follows:

1. A refuse container for receiving refuse, said refuse container being mountable to a stable surface such as a wall or a ground surface, said refuse container comprising:

an anchoring structure;

an anchoring structure-to-stable surface attachment means for solidly attaching said anchoring structure to said stable surface;

a protective casing defining an enclosed casing volume, said protective casing also defining a casing aperture for allowing said refuse to be inserted into said casing volume;

a casing-to-anchoring structure releasable attachment means for releasably attaching said protective casing to said anchoring structure;

an open top refuse receptacle mounted within said casing volume and positioned so as to receive said refuse when dropped into said casing volume from said casing aperture;

a theft prevention means for selectively preventing the detachment of said protective casing from said anchoring structure and selectively preventing the withdrawal of said refuse receptacle from said casing volume said protective casing including a first casing segment and a second casing segment, said first casing segment and said second casing segment being detachably attached together by a segment attachment means;

said theft prevention means including a releasable locking means for releasably locking together said first casing segment and said second casing segment in a segment locked configuration;

said casing aperture extending through said first casing segment and said casing-to-anchoring structure releasable attachment means cooperating with said second casing segment for releasably attaching said protective casing to said anchoring structure;

said anchoring structure defining a generally horizontally extending hooking edge and a generally vertical fastening surface;

said second casing segment including a rear wall;

a hooking structure extending rearwardly from said rear wall, said hooking structure being configured, sized and positioned so as to be releasably hookable over said hooking edge part of said anchoring structure;

a casing-to-anchoring structure fastening means extending through both said rear wall and said fastening surface for fastening said casing to said anchoring structure when said hooking structure is hooked on said hooking edge, said fastening means being configured so as to be accessible only when said first casing segment is at least partially separated from said second casing segment.

2. A refuse container as recited in claim 1 wherein said rear wall has a generally rectangular configuration defining a rear wall upper peripheral edge, a rear wall lower peripheral edge and a pair of opposed rear wall side peripheral edges, said hooking structure extending rearwardly from said rear wall substantially adjacent said rear wall upper peripheral edge;

said casing-to-anchoring structure fastening means including at least one rear wall aperture extending through said rear wall substantially adjacent said rear wall lower peripheral edge;

said hooking structure defines a generally horizontally extending first anchoring strip, said first anchoring strip defining said hooking edge;

said hooking structure also defines a generally horizontally extending second anchoring strip;

said casing-to-anchoring structure fastening means also includes at least one anchoring strip aperture extending through said second anchoring strip so as to be substantially in register with said at least one rear wall aperture when said hooking structure is hooked on said hooking edge;

said casing-to-anchoring structure fastening means further includes a fastening component extending through both said at least one rear wall aperture and said at least one anchoring strip aperture when said casing is fastened to said anchoring structure.

3. A refuse container as recited in claim 2 wherein said anchoring structure includes an anchoring base and a pair of anchoring posts extending upwardly from said anchoring base, said anchoring strips extending between said anchoring posts; whereby said anchoring base is anchorable to said ground surface using said anchoring structure-to-stable surface attachment means.

4. A refuse container as recited in claim 2 wherein said anchoring structure includes an anchoring plate and a pair of plate spacing legs extending substantially outwardly from said anchoring plate, said anchoring strips extending from said plate spacing legs; whereby said anchoring plate is anchorable to said wall surface using said anchoring structure-to-stable surface attachment means.

5. A refuse container as recited in claim 2 wherein said first casing segment and said second casing segment when assembled together cooperate to form a segment guiding means, said segment guiding means allowing said first casing segment and said second casing segment to move relative to each other in a predetermined axial direction while preventing other relative displacements therebetween; said releasable locking means releasably and selectively preventing relative displacement between said first casing segment and said second casing segment along said predetermined axial direction.

6. A refuse container as recited in claim 5 wherein said second casing segment defines a bottom wall, said bottom wall extending from said rear wall lower peripheral edge, said bottom wall defining a bottom wall rear peripheral edge merging with said rear wall lower peripheral edge, a bottom wall front peripheral edge and a pair of opposed bottom wall side peripheral edges;

said first casing segment defines a front wall, said front wall defining a front wall upper peripheral edge, a front wall lower peripheral edge and a pair of opposed front wall side peripheral edges;

said first casing segment also defines a top wall, said top wall extending from said front wall upper peripheral edge, said top wall defining a top wall front peripheral edge merging with said front wall upper peripheral edge, a top wall rear peripheral edge and a pair of opposed top wall side peripheral edges;

said first casing segment further defines a pair of side walls, each of said side walls defining a corresponding side wall upper peripheral edge merging with an adjacent top wall side peripheral edge, each of said side walls also defining a corresponding side wall lower peripheral edge merging with an adjacent bottom wall side peripheral edge, each of said side walls further defining a corresponding side wall front peripheral edge merging with an adjacent front wall side peripheral edge;

said releasable locking means including a locking lip extending inwardly from said front wall lower peripheral edge and a locking mechanism mounted on said bottom wall adjacent said bottom wall front peripheral edge, said locking mechanism being provided with a locking tongue, said locking tongue being pivotally mounted on said bottom wall so as to selectively pivot between said segment locked configuration whereby said locking tongue abuttingly contacts said locking lip and a segment unlocked configuration whereby said locking tongue clears said locking lip.

7. A refuse container as recited in claim 6 wherein said top wall is provided with a top wall lip extending substantially downwardly and at an angle from said top wall rear peripheral edge, said top wall and said top wall lip together defining a top wall hooking section, said top wall hooking section being hookingly mounted over said rear wall upper peripheral edge when said first casing segment and said second casing segment are assembled together.

8. A refuse container recited in claim 7 further comprising a top wall guiding tongue extending from the inner surface of said top wall, said top wall guiding tongue having a tongue guiding section that extends in a generally parallel and inwardly spaced relationship relative to said top wall lip so as to define a top wall guiding channel therebetween, said top wall guiding channel being configured and sized for substantially fittingly and slidably receiving said rear wall upper peripheral edge.

9. A refuse container recited in claim 7 wherein said rear wall is provided with a rear wall recessed section positioned adjacent said rear wall upper peripheral edge, said top wall recessed section defining a rear wall spacing segment and a rear wall abutting segment, said rear wall spacing segment extending substantially inwardly and at an angle relative to an adjacent section of said rear wall, said rear wall abutting segment extending substantially upwardly from said rear wall spacing segment in a generally parallel and inwardly recessed relationship relative to said adjacent section of said rear wall, whereby when said first and second casing segments are assembled, a distal tip of said top wall lip abuttingly contacts the exterior surface of said rear wall spacing segment and the inner surface of said top wall lip abuttingly contacts the exterior surface of said rear wall abutting segment.

10. A refuse container as recited in claim 7 wherein each of said side walls is provided with a side wall rear lip and a side wall bottom lip, each of said side wall rear lips extending substantially inwardly and perpendicularly relative to said side wall rear peripheral edge; each of said side wall bottom lips extending substantially inwardly and perpendicularly relative to said side wall bottom peripheral edge; whereby said side wall rear lips and said side wall bottom lips abuttingly contact respectively said rear wall and said bottom wall when said first and second casing segments are assembled together.

11. A refuse container as recited in claim 10 further comprising a refuse container releasable mounting means extending from the inner surface of said front wall for releasably mounting said refuse container to said front wall in a spaced relationship relative to said bottom wall.

12. A refuse container as recited in claim 10 wherein a lip spacing is provided between adjacent side wall rear lips and side wall bottom lips, said lip spacing being configured and sized so as to allow slidable movement thereinto of said rear wall; whereby when said first and second casing segments are assembled together the inner surface of said side wall rear lips abuttingly contacts the outer surface of said rear wall,the outer surface of said side wall bottom lips abuttingly contact the inner surface of said bottom wall and a segment of said rear wall adjacent each rear wall peripheral edge is inserted between said side wall rear lips and said side wall bottom lips.

13. A refuse container as recited in claim 10 wherein a lip abutment rail extends substantially inwardly from both said rear wall and said bottom wall respectively adjacent said rear wall side peripheral edges and said bottom wall side peripheral edges; whereby when said first and second casing segments are assembled together the inner surface of said side wall rear lips abuttingly contacts the inner surface of said rear wall, the outer surface of said side wall bottom lips abuttingly contact the inner surface of said bottom wall and the inner peripheral edge of said side wall rear lips and said side wall bottom lips abuttingly contact said lip abutment rails.

14. A refuse container as recited in claim 13 further comprising a guiding rod extending from the inner surface of said bottom wall, said guiding rod also extending trough a guiding rod aperture formed in one of said side wall bottom lips; whereby said guiding rod guides the relative movement between said first and second casing segments when the latter are separated from each other.

15. A refuse container as recited in claim 14 wherein said guiding rod defines a guiding rod distal end, said guiding rod distal end being provided with a course limiting means for limiting the relative movement between said first and second casing segments when the latter are separated from each other.

* * * * *